US005101894A

United States Patent [19]

Hendricks

[11] Patent Number: 5,101,894

[45] Date of Patent: Apr. 7, 1992

[54] PERFORATED PLATE HEAT EXCHANGER AND METHOD OF FABRICATION

[75] Inventor: John B. Hendricks, Huntsville, Ala.

[73] Assignee: Alabama Cryogenic Engineering, Inc., Huntsville, Ala.

[21] Appl. No.: 375,709

[22] Filed: Jul. 5, 1989

[51] Int. Cl.[5] ..... F28F 3/00

[52] U.S. Cl. ..... 165/164; 165/154; 62/51.2; 29/890.034

[58] Field of Search ..... 165/4, 10, 154, 164, 165/165; 62/51.2

[56] References Cited

U.S. PATENT DOCUMENTS 3,228,460 1/1966 Garwin ..... 165/154
3,273,356 9/1966 Hoffman ..... 62/51.2
3,692,099 9/1972 Nesbitt et al. .

*Primary Examiner*—Albert W. Davis, Jr.
*Attorney, Agent, or Firm*—Phillips & Beumer

[57] ABSTRACT

Perforated plate heat exchangers and cryocoolers based on plates with extremely small, tubular holes are disclosed. The plates may have hole diameters down to the low micron size range and length-to-diameter ratios above unity and from 2 to 6 for typical applications. Such perforated plates function as tubes rather than screens and provide high efficiency, especially for compact cryocooler applications. The plates, which are made of a high thermal conductivity metal, and alternating spacers of low thermal conductivity material are disposed in an elongated stacked array of a large number of units such as 100. For use in a recuperative heat exchanger for a cryocooler employing the Linde-Hampson cycle, webs at the plate and spacer edges and a strip across the middle define two flow chambers, one for gas flow in each direction. One end of the array communicates with a high-pressure gas inlet for introducing gas in one chamber and a low-pressure gas outlet for removing gas from the other chamber. The other end of the array is coupled with a Joule-Thomson expander plate and a liquid collector. Such a cryocooler operates at cryogenic temperatures and provides high efficiency in a compact size. Input gas pressure requirements are low enough to be provided by a mechanical compressor. A process for fabricating perforated plates with the stated properties is also disclosed.

10 Claims, 3 Drawing Sheets

PERFORATED PLATE HEAT EXCHANGER AND METHOD OF FABRICATION

FIELD OF THE INVENTION

This invention relates to heat exchangers and more particularly to perforated-plate heat exchangers for compact cryocoolers.

BACKGROUND OF THE INVENTION

High efficiency, compact heat exchangers are needed for applications such as in cryocoolers for providing extremely low temperatures, for example, 80K, which are required for operation of long wavelength infrared sensors. Cooling systems for use in missiles and space equipment must also be rugged enough to withstand the launch environment and must provide space compatibility as required. Another desirable feature for such applications is the capability to operate with a relatively low source pressure. This makes the design of a mechanical compressor much easier and will also increase the operating time if high pressure, stored gas cylinders are used as the gas supply.

One approach to meeting requirements for compact, efficient cooling systems is the perforated-plate heat exchanger. Such heat exchangers are made up of a large number of parallel, perforated plates of high thermal conductivity metal in a stacked array, with gaps between plates being provided by spacers. Gas flows longitudinally through the plates in one direction and counterflows in the opposite direction through separated portions of the plates. Heat transfers laterally across the plates from one stream to the other. Operating principles of this type of heat exchanger are disclosed by R. B. Fleming in *Advances in Cryogenic Engineering*, Vol. 14, pages 197–204. As stated in this reference, a very large heat-transfer surface area per unit volume can be obtained by use of very small holes; the result is a favorable factor in miniaturization. While the reference discloses the desirability of very small holes, the actual device disclosed employs plates 0.81 mm thick with holes 1.14 mm in diameter and a resulting length-to-diameter ratio in the range of 0.5 to 1.0, the device being designed to operate from room temperature to 80K. In order to improve operation of a compact cryocooler, much smaller holes, in the low micron diameter range, and thinner plates with higher length-to-diameter ratios are needed. Available methods for producing holes, such as by punching as disclosed in this reference, are not effective for the desired hole sizes. In addition to being extremely small, the holes should be uniform in size and shape throughout their length so as to function in the same manner as tubes.

Various types of perforated plates for use in heat exchangers are shown in prior patents. U.S. Pat. No. 4,209,061 discloses perforated plates with large-diameter holes disposed in a stack with the holes slightly offset from one another. U.S. Pat. No. 3,216,484 discloses a cryogenic regenerator having perforated plates with much higher perforated diameters than required for purposes of the present invention. Small holes which make up a very small area of a perforated plate are disclosed in U.S. Pat. No. 3,692,095 for the purpose of providing a slow leak effect.

Compact cryocoolers using other approaches are disclosed in U.S. Pat. Nos. 4,781,033 and 4,489,570. The former of these patents shows layering of fine wire mesh screen to obtain a finely divided heat transferring matrix, and the latter discloses micron-size channels etched in the interfaces of glass plates, but neither of them is concerned with perforated plates.

None of the prior references discloses perforated plates having the required hole structure discussed above or suggests how plates with that structure could be fabricated.

DEFINITIONS

"Tubular" as used herein with reference to plate perforations is intended to include holes having an oval or other non-circular cross section as well as circular ones. The term "diameter" when applied to such non-circular holes means the effective hydraulic diameter.

SUMMARY OF THE INVENTION

This invention is directed to perforated plate heat exchangers based on thin, thermally-conductive metal plates having very small, aligned tubular holes. The holes may have diameters in the low micron size range, providing for a high ratio of hole length-to-diameter for plates of minimum practical thickness. The availability of plates with holes of this size and length-to-diameter ratio enables design of highly effective compact heat exchangers for operation at cryogenic temperatures. Perforated plates with holes having a length-to-diameter ratio greater than unity provide an advantage in that such holes may be treated as tubes rather than screens. This both facilitates analysis and yields a lower pressure drop per unit of heat exchange. Heat exchangers using these plates generally include an elongated stacked array of the plates alternating with spacers of low thermal conductivity material and arranged to provide one or more chambers or sets of flow paths across the plates and through the array. In a particular application for a recuperative heat exchanger for use in a cryocooler, a large number of circular perforated plates and spacers are bonded together around their circumference and along a dividing strip across the middle of the array, providing a high pressure gas flow chamber on one side and a low pressure gas flow chamber on the other side. At one end of the array a gas inlet is provided for introducing gas to the high pressure side, and an outlet is disposed on the other side for egress of low pressure gas. The other end of the array is coupled to a Joule-Thomson expander plate and a liquid collector region wherein cooling to cryogenic temperatures is effected. Gas exiting through the low pressure side cools incoming high-pressure gas by transfer of heat laterally across the plates.

Perforated plates having holes of the desired size and uniformity may be prepared by a "compound wire drawing" process wherein a matrix of the plate metal disposed around wires of a sacrificial material is repeatedly coextruded to obtain a composite having very fine wires uniformly distributed throughout the matrix followed by slicing off of plates and etching away the wire material, leaving perforated plates. Uniform, tubular perforations having diameters down to the low micron size range may be obtained by this means.

Various types of heat exchange devices including recuperative and regenerative heat exchangers may be constructed in accordance with the invention, and the heat exchanger may be designed for use in cooling systems based on a number of refrigeration cycles including the Linde-Hampson, Brayton, and Stirling cycles.

It is, therefore, an object of this invention to provide a high efficiency, compact, perforated plate heat exchanger.

Another object is to provide a perforated plate heat exchanger having plates with uniform tubular perforations of extremely small size.

Yet another object is to provide a heat exchanger with very thin perforated plates having perforations with a high-length-to-diameter ratio.

Still another object is to provide a method of fabricating very thin perforated plates with uniform tubular perforations having a diameter in the low micron size range.

Other objects and advantages of the invention will be apparent from the following detailed description and appended claims.

DESCRIPTION OF THE PREFERRED EMBODIMENT

Figure 1:
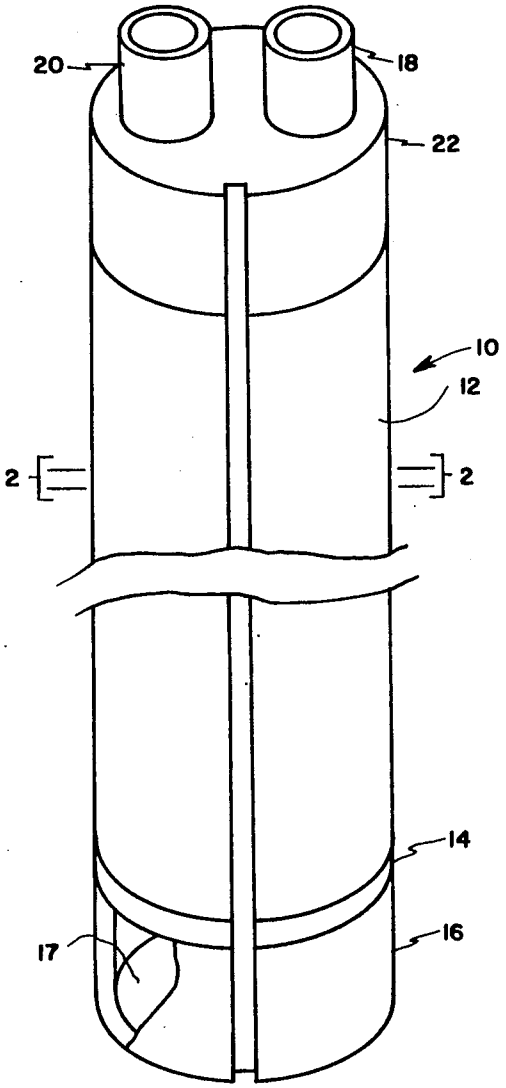
FIG. 1 is an isometric view partially cut away of a cryocooler embodying the invention.

Referring to FIG. 1 of the drawings, there is shown a cryocooler 10 which includes a perforated plate heat exchanger 12, a Joule-Thomson expander plate 14, and a liquid collector 16. The cryocooler is based on the Linde-Hampson refrigeration cycle using a recuperative heat exchanger. Although the invention is not limited to such conditions, the cryocooler is designed to operate between 20K to 4K to provide a cooling power of 10 mW at 4.2K. The cryocooler uses a helium gas source pressure of seven atmospheres, which is a level that may be provided by a mechanical compressor.

Figure 2:
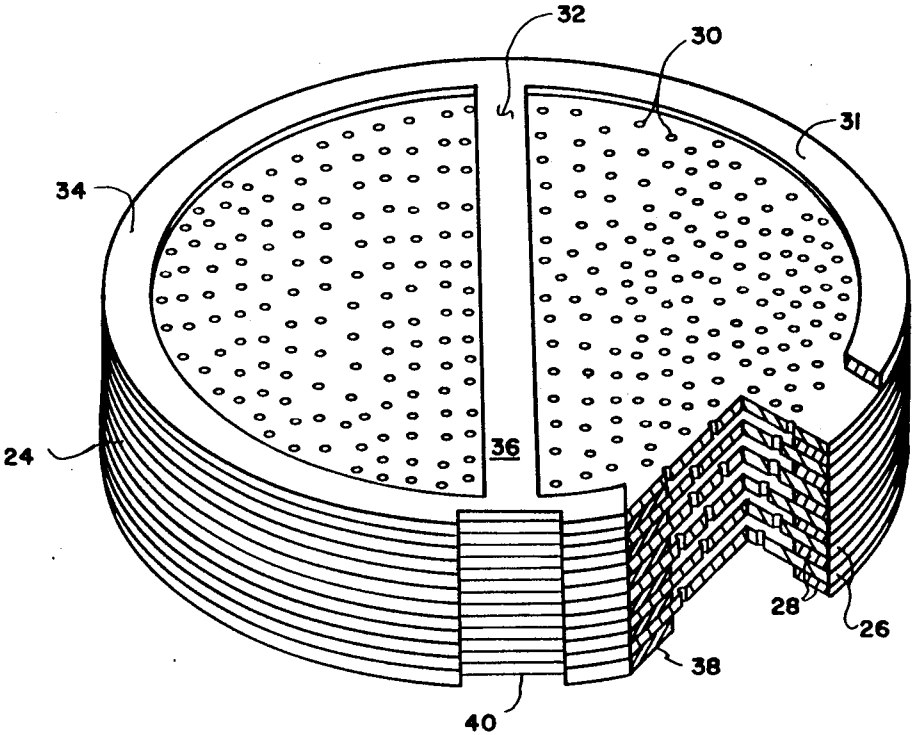
FIG. 2 is an enlarged isometric view, partially broken away, of the bracketed portion of the stacked perforated plate array of the cryocooler taken as shown by line 2—2 of FIG. 1.

Heat exchanger 10 at its top communicates with high pressure inlet pipe 18 and low pressure gas outlet pipe 20 supported by header 22. The heat exchanger has a stacked array 24 of a large number, such as 100, of perforated plates 26 alternated with spacers 28 (FIG. 2). The perforated plates are made of a metal with high thermal conductivity to enable transfer of heat laterally across the plates while the spacers are made of low thermal conductivity material to provide minimized transfer of heat in the axial direction. Although different combinations of plate and spacer materials may be used, depending on the requirements for a particular application, molybdenum plates and alumina spacers are preferred for the embodiment shown to obtain high strength consistent with effective heat transfer characteristics. Plates 26 are thin and circular in shape, and they are penetrated by a larger number of holes or perforations 30 that are tubular and aligned with one another. (The diameter of the perforations shown in FIG. 2 is exaggerated for purposes of clarity, and the number shown is less than the number actually present for the same reason.) Spacers 28 are in the form of flat circular rings having a circumferential web 31 with an outer edge corresponding to the edge of the plates and a strip 32 extending across the middle of the array. When bonded together, the stacked plates and spacers form an outer wall 34 around the circumference of the array and a center wall 36 defining two axially extending flow compartments. Upper and lower faces of the plates have thin coatings 38 of a metal such as nickel deposited thereon at locations in contact with webs 30 and strips 32 as required to effect bonding of the plates and spacers. A longitudinally extending notch 40 is provided in the plates and spacers for alignment in a fixture during bonding.

The perforated plates in the embodiment shown may have a thickness of 0.12 mm and a diameter of 3.2 mm, with the perforations having a diameter of 15.2 microns, thus providing a length-to-diameter ratio of 7.9. Outer webs and center strips of the spacers have a width of 0.18 mm in this embodiment. Perforations in the plate occupy thirty percent of the plate area.

Joule-Thomson expander plate 14 is bonded to the lowermost perforated plate and has a porous structure, enabling the high pressure gas to expand as it passes through, thus providing a cooling effect. Collector 16 is in the form of a hollow cup terminating in end cap 17 which in operation is disposed in heat transfer relation with the object to be cooled, such as an infrared sensor (not shown).

Another cryocooler embodiment generally similar to the embodiment described above operates between 20K and 4K and provides a cooling power of 10 mW, using the Linde-Hampson cycle. The perforated plate heat exchanger has molybdenum plates and alumina spacers, both 0.130 mm thick. The plates have a diameter of 2.7 mm, and the holes penetrating the plates are 21.3 microns in diameter, providing a hole length-to-diameter ratio of 6. Width of the spacer strips is 0.254 mm, and overall length of the stacked array is 76.8 mm. Pressure drop across the low pressure side is $10^{-2}$ MPa, and a supply pressure of 0.709 MPa is used. Design effectiveness of this cryocooler is 0.98.

Figure 3:
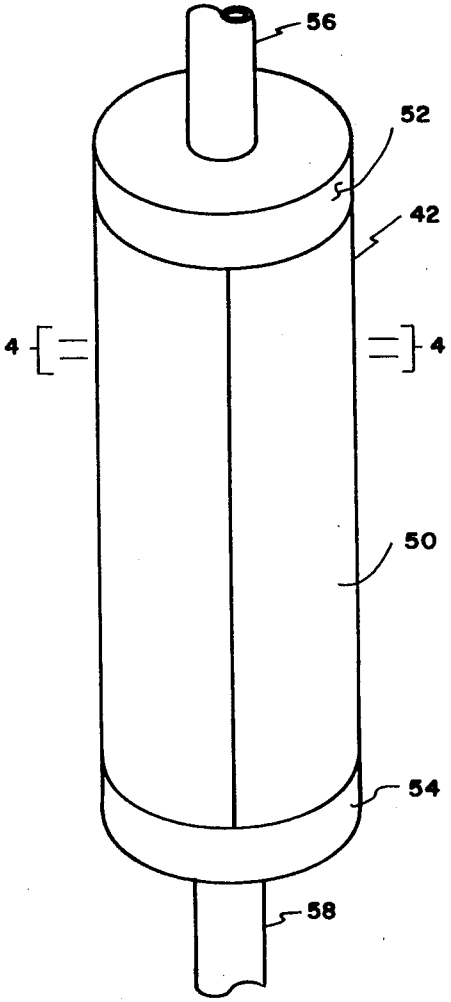
FIG. 3 is an isometric view of a regenerative heat exchanger embodying the invention.
Figure 4:
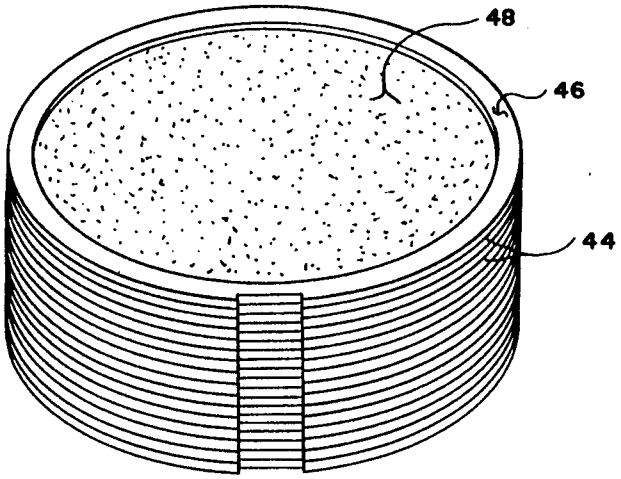
FIG. 4 is an enlarged view of the bracketed portion of the stacked perforated plate array of the heat exchanger taken as shown by line 4—4 of FIG. 3.
Figure 5:
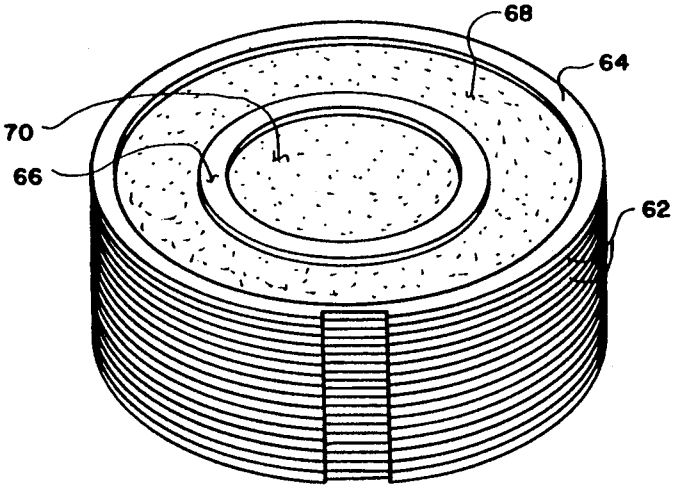
FIG. 5 is an isometric view of stacked perforated plates of another embodiment of the invention.

FIGS. 3 and 4 show an embodiment of the invention wherein a stacked array of perforated plates and spacers is employed in a regenerative heat exchanger 42 having only one flow chamber. The stacked array has plates 44 alternating with spacers 46 in the same manner as for the embodiments described above except that the spacers do not include a strip across the array. The plates are perforated by a large number of holes 48 having characteristics as described above. Housing 50 encloses the stacked array on its side, and headers 52 and 54, at the top and bottom communicate the array with and support gas flow pipes 56 and 58. This type of heat exchanger may be used for applications wherein gas flow through the exchanger is periodically reversed to provide desired heat transfer effects. A specific regenerator of this construction for Stirling cycle operation at temperatures between 300 and 80K at a power level of one watt has the following characteristics: copper plates; stainless steel spacers; design effectiveness, 0.98; plate diameter, 4.05 mm; hole diameter, 61.2 microns; plate thickness, 0.130 mm; thickness of spacers, 50.0 microns; width of spacer webs, 0.102 mm; number of plates, 166; and length-to-diameter ratio of holes, 2.12. FIG. 5 shows an embodiment for a recuperative heat exchanger using the Linde-Hampson cycle, with two flow paths being obtained by a circular wall concentric with and disposed within the plate diameter. This construction enables the area of one flow path to be made substantially larger than the area of the other. The heat exchanger has a stacked array of perforated plates 62 alternating with spacers, a circumferential spacer 64 and inner circular spacers 66 being disposed in each spacer layer. The inner spacer, when bonded between plates, forms a circular wall defining outer flow path 68 and inner flow path 70. Each of the flow paths communicates with a separate gas flow pipe in the manner shown for the embodiment of FIG. 1. An embodiment using this structure and providing a cooling power of 0.25 watt operating between 300 and 80K has the following characteristics: niobium plates; glass ceramic spacers; thickness of plates, 0.130 mm; diameter of holes, 21.7 microns; width of spacers, 2.5 mm; thickness of spacers, 1.0 mm; length-to-diameter ratio of holes, 6; diameter of inner flow path, 0.509 mm; and equivalent diameter of outer flow path, 1.69 mm.

Selection of materials for the perforated plates and spacers is an important aspect of the invention. The plate material must have a high thermal conductivity to facilitate heat transfer between the hot and cold fluids, and it must also have properties that are consistent with the plate fabrication process. For missile and space applications, a high degree of strength is necessary to provide the required ruggedness. The spacer material must have a low thermal conductivity as well as high strength for rugged applications. In addition to these individual properties, the plate and spacer material should have coefficients of thermal expansion that do not differ widely from one another to avoid large stresses when the heat exchanger is cooled in operation. Since the plate and spacer must be sealed to one another, they must also be amenable to sealing in fabrication of the exchanger. Three plate-spacer combinations which meet the above requirements in varying degrees are copper/stainless steel, molybdenum/alumina, and niobium/glass ceramic. Owing to its very high thermal conductivity, copper would be the material of choice for many applications; however, its strength is not high enough for high ruggedness applications. Molybdenum provides high strength with acceptably high thermal conductivity, and its use in combination with alumina is preferred for the embodiments described above that operate at liquid helium temperature. Niobium meets most requirements, but it undergoes superconducting transition at about 9.2K, at which temperature its thermal conductivity becomes very small. Thus, its use would be limited to operating temperatures above the transition temperature.

Heat exchangers embodying the invention are illustrated by the four specific embodiments described above. Other embodiments may be designed using known analytical methods to determine the required pressure drop across the heat exchanger, the number of heat transfer units required, which in turn is a measure of the required effectiveness, and the dimensions needed to provide these quantities. In general, plates having perforations from 1 to 300 microns may be used, with preferred values for the specific embodiments ranging from 15.2 to 61.2 microns. The plate thickness, which is limited to a minimum of about 0.1 mm by manufacturing process, may be selected to provide a desired length-to-diameter ratio of the perforation and other design features, with a thickness of 0.130 mm being used in the specific embodiments. Heat exchangers employing these plates preferably will incorporate a large number, in excess of 100, of plates in the stacked array, with the specific number of plates being determined by design considerations.

Figure 6:
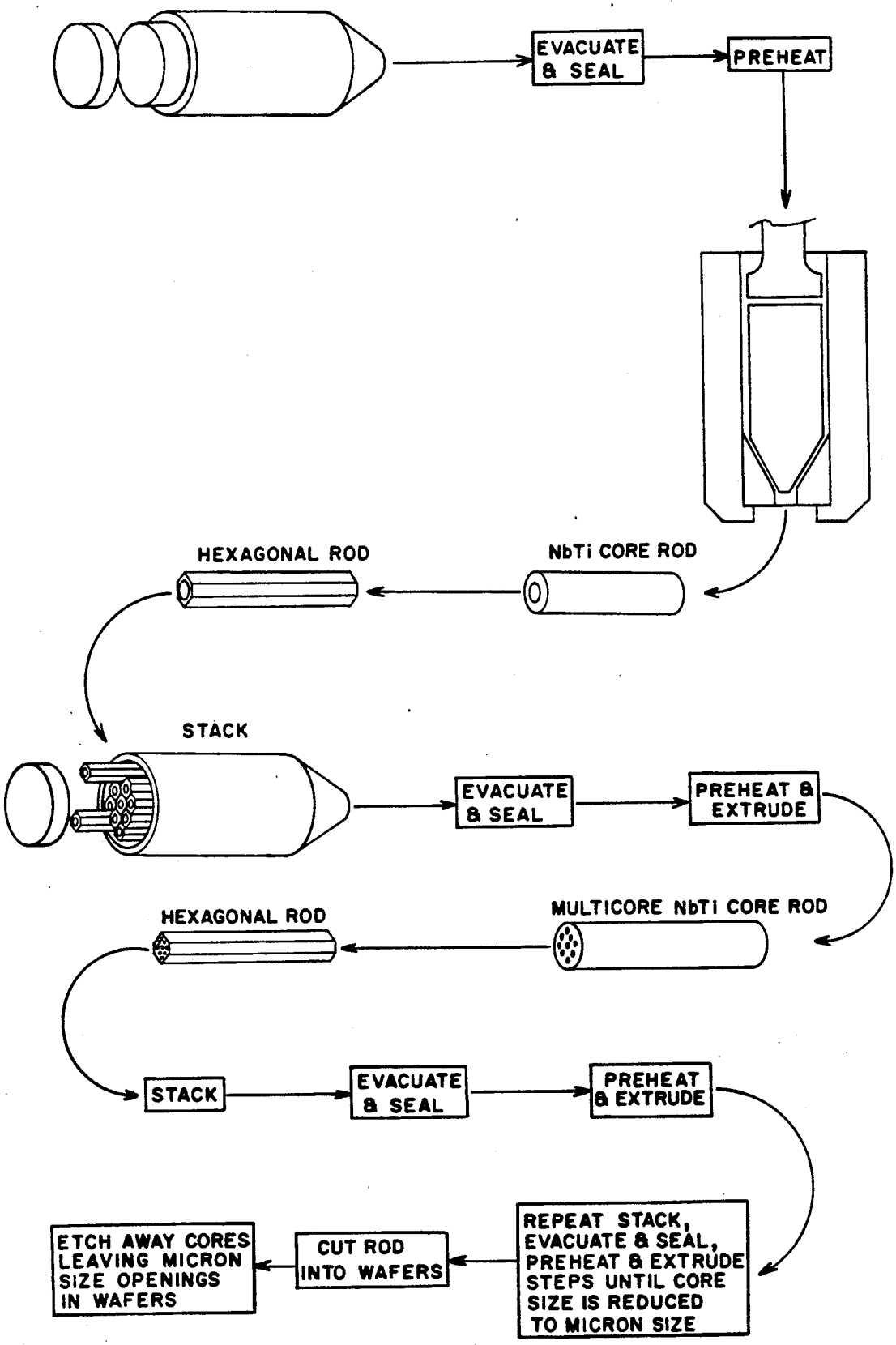
FIG. 6 is a schematic view of a process for fabrication of perforated plates according to the invention.

FIG. 6 shows in schematic form a process for fabrication of very thin perforated plates with uniform tubular perforations having a diameter in the low micron size. In this process, a billet of sacrificial wire material such as NbTi alloy is disposed in an extrusion can of the desired plate material, such as copper. After evacuation, preheating and sealing, the extrusion can is placed in a suitable die and extruded to produce an alongated, thinned out rod having a center of the wire material. An assembly of extruded rods, machined to hexagonal cross section, is then stacked in an extrusion can and the above procedure is repeated until a desired number and size of wires is obtained in a composite rod. Thin plates are then sliced off the rod using electric discharge milling. Perforations are then produced by selectively etching away the wire by using a suitable etchant for the wire material, for example, hydrofluoric acid for NbTi, leaving a perforated matrix.

Fabrication of a heat exchanger and cryocooler from the plates, spacers, and other components may be accomplished by stacking the plates and alternating spacers and brazing the assembly, with a thin sheet of brazing alloy such as a CuAg eutectic bieng disposed at the surfaces to be joined, the surfaces having first been sputter coated with a thin layer of nickel or chromium. Proper alignment during brazing may be maintained by use of a suitable alignment jig or fixture that engages the longitudinal notch shown on the plates and spacers. The header, Joule-Thomson expander plate, and liquid collector are preferably also placed in position to provide an overall asembly, which is then disposed in a brazing furnace.

Various other types of heat exchangers may be designed to take advantage of the novel perforated plates of this invention. The availability of very thin plates with uniform, aligned tubular perforations with a high length-to-diameter ratio provides for high efficiency consistent with good structural integrity for cryocooler applications. While the invention has been described above with respect to certain specific embodiments, it is not to be understood as limited thereby, but is limited only as indicated by the appended claims.

I claim:

1. A heat exchanger comprising a stacked array of alternating perforated thin plates of a metal having a high thermal conductivity and spacers having a low thermal conductivity, bonded together and arranged to define at least one gas flow path through the array, and gas inlet means and gas outlet means, said plates being perforated by a multiplicity of uniform sized, tubular holes having a uniform cross-sectional shape over their length, a diameter of 1 to 300 microns and a length-to-diameter ratio greater than 1, and said perforated plates being prepared by a compound wire drawing process in which a matrix of the plate metal disposed around wires of a sacrificial metal is repeatedly coextruded to obtain a composite body having very fine, longitudinally extending wires distributed uniformly throughout the matrix of the body, is sliced to produce thin plates, and the plates are subjected to etching to remove the sacrificial wire metal.

2. A heat exchanger as defined in claim 1 wherein said plates and spacers are circular in shape, and the spacers in each layer in the array include a first flat ring having an outer diameter equal to the diameter of the plates and a second, smaller flat ring disposed inside of, spaced apart from, and concentric with the first spacer, defining a cylindrical housing having a first flow path through the axis of the array and a second longitudinal flow path defined by the area between the two spacers.

3. A heat exchanger as defined in claim 1 wherein said plates and spacers comprise a pair of materials selected from the group consisting of copper/stainless steel, molybdenum/alumina, and niobium/glass ceramic.

4. A heat exchanger as defined in claim 1 wherein said holes have a diameter of 15.2 to 61.2 microns.

5. A heat exchanger as defined in claim 1 including at least 100 pairs of plates and spacers in said stacked array.

6. A cryocooler for operation at liquid helium temperature comprising:

a stacked, generally cylindrical array of perforated plates bonded to spacers of low thermal conductivity material, said plates having tubular holes from 1 to 300 microns in diameter a length-to-diameter ratio greater than 1;

said spacers including a strip extending across the axis of the array and defining wall means dividing the array into two flow paths having a semi-circular cross section;

high-pressure gas inlet means communicating at one end of the array with the first of said chambers;

low-pressure gas outlet means communicating at the same end of the array with the second of said chambers;

a Joule-Thomson expander plate communicating with said first chamber at the opposite end of said array;

liquid collector means communicating with said expander plate;

gas return means communicating said liquid collector with said second chamber at said opposite end of said array; and heat transfer means coupling said collector means with an object to be cooled.

7. A cryocooler as defined in claim 6 wherein said plates are comprised of molybdenum, and said spacers are comprised of alumina.

8. A cryocooler as defined in claim 6 wherein said plates are comprised of niobium, and said spacers are comprised of glass ceramic.

9. A heat exchanger comprising a stacked array of alternating perforated thin plates of a metal having a high thermal conductivity and spacers having a low thermal conductivity, bonded together and arranged to define at least one gas flow path through the array, and gas inlet means and gas outlet means, said plates being perforated by a multiplicity of uniform sized, tubular holes having a diameter of 1 to 300 microns and a length-to-diameter ratio greater than 1, said plates and spacers being circular in shape, and the spacers including a circumferential web and a strip across the axis of the array, defining a cylindrical housing having a first flow path through the array in one direction and a second flow path therethrough in the opposite direction.

10. A cryocooler for operation at liquid helium temperature comprising:

a stacked, generally cylindrical array of perforated plates bonded to spacers of low thermal conductivity material, said plates having tubular holes from 1 to 300 microns in diameter and a length-to-diameter ratio greater than 1, said holes having a uniform cross-sectional shape over their length, and said plates being prepared by a compound wire drawing process in which a matrix of the plate metal disposed around wires of a sacrificial metal is repeatedly coextruded to obtain a composite body having very fine, longitudinally extending wires distributed uniformly throughout the matrix of the body, is sliced to produce thin plates, and the plates are subjected to etching to remove the sacrificial wire metal;

said spacers defining wall means dividing said array into first and second longitudinal gas flow chambers;

high-pressure gas inlet means communicating at one end of the array with the first of said chambers;

low-pressure gas outlet means communicating at the same end of the array with the second of said chambers;

a Joule-Thomson expander plate communicating with said first chamber at the opposite end of said array;

liquid collector means communicating with said expander plate;

gas return means communicating said liquid collector with said second chamber at said opposite end of said array; and heat transfer means coupling said collector means with an object to be cooled.

* * * * *